US008163112B2

(12) United States Patent
Gooch et al.

(10) Patent No.: US 8,163,112 B2
(45) Date of Patent: Apr. 24, 2012

(54) METHOD OF FABRICATING A URANIUM-BEARING FOIL

(75) Inventors: Jackie G. Gooch, Seymour, TN (US); Amy L. DeMint, Kingston, TN (US)

(73) Assignee: Babcock & Wilcox Technical Services Y-12, LLC, Oak Ridge, TN (US)

( * ) Notice: Subject to any disclaimer, the term of this patent is extended or adjusted under 35 U.S.C. 154(b) by 337 days.

(21) Appl. No.: 12/436,209

(22) Filed: May 6, 2009

(65) Prior Publication Data

US 2010/0282375 A1 Nov. 11, 2010

(51) Int. Cl.
*C22B 60/00* (2006.01)

(52) U.S. Cl. ..... 148/560; 29/17.2; 29/527.7; 72/234

(58) Field of Classification Search ..... None
See application file for complete search history.

(56) References Cited

U.S. PATENT DOCUMENTS 2,877,149 A * 3/1959 Kaufmann ..... 148/560
4,705,577 A * 11/1987 Ondracek ..... 419/8
7,100,670 B1 * 9/2006 Hofman et al. ..... 164/76.1

OTHER PUBLICATIONS

William F. Smith, Foundations of Materials Science and Engineering, (1993), McGraw-Hill, Second Edition, pp. 184-185.*

* cited by examiner

*Primary Examiner* — George Wyszomierski
(74) *Attorney, Agent, or Firm* — Michael J. Renner, Esq.; Luedeka, Neely & Graham, P.C.

(57) ABSTRACT

Methods of fabricating a uranium-bearing foil are described. The foil may be substantially pure uranium, or may be a uranium alloy such as a uranium-molybdenum alloy. The method typically includes a series of hot rolling operations on a cast plate material to form a thin sheet. These hot rolling operations are typically performed using a process where each pass reduces the thickness of the plate by a substantially constant percentage. The sheet is typically then annealed and then cooled. The process typically concludes with a series of cold rolling passes where each pass reduces the thickness of the plate by a substantially constant thickness amount to form the foil.

15 Claims, 1 Drawing Sheet

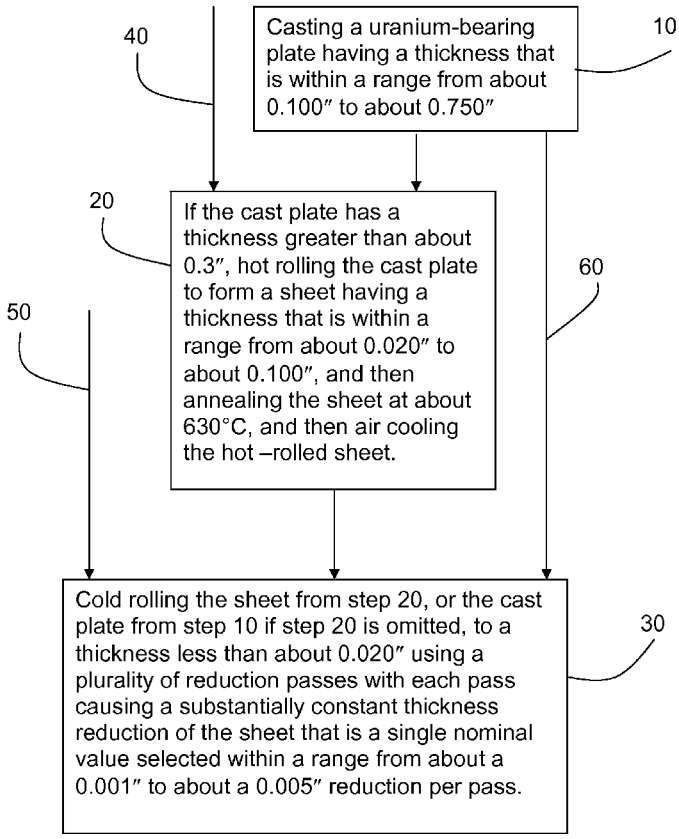

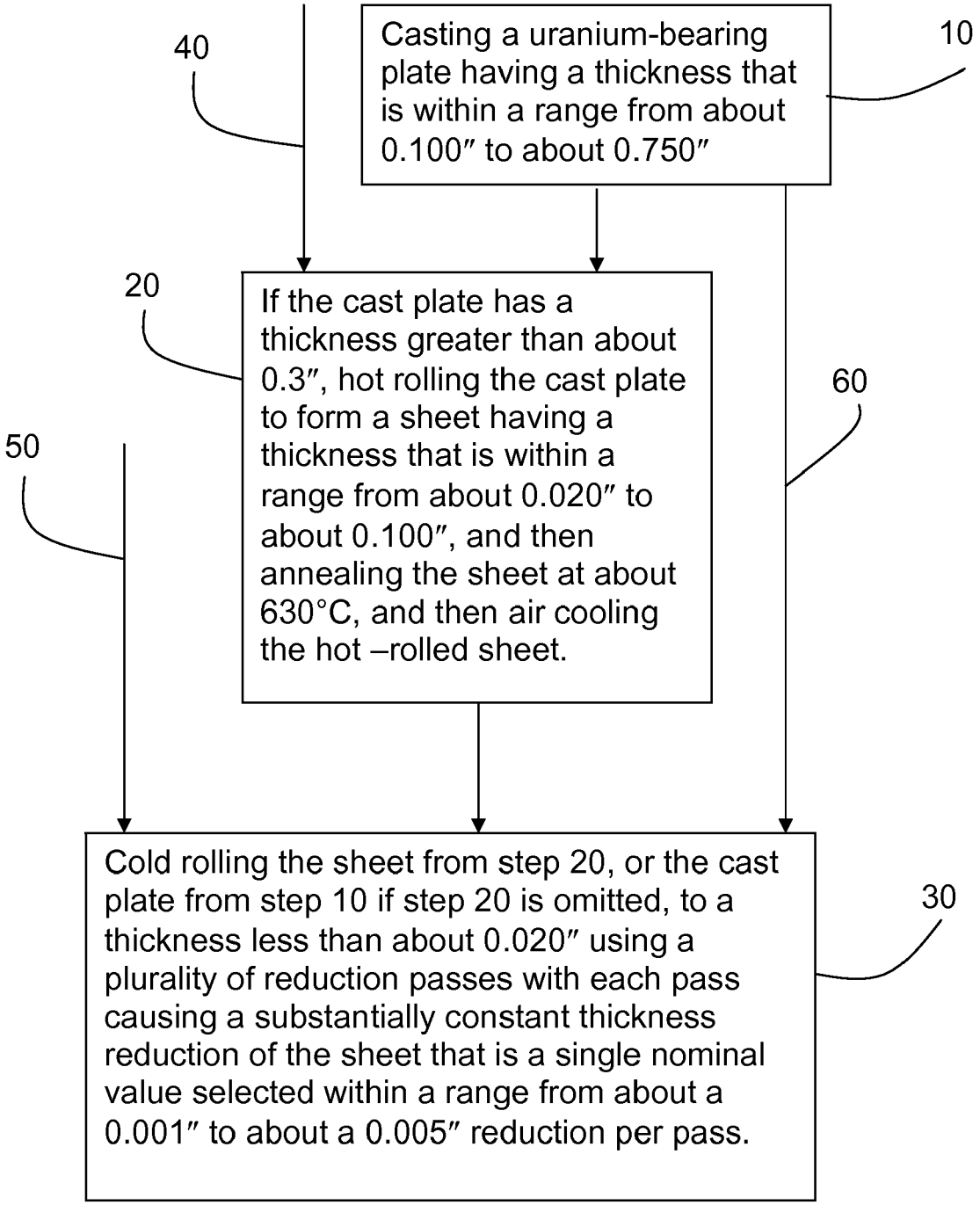
Casting a uranium-bearing plate having a thickness that is within a range from about 0.100″ to about 0.750″
10
40
20
If the cast plate has a thickness greater than about 0.3″, hot rolling the cast plate to form a sheet having a thickness that is within a range from about 0.020″ to about 0.100″, and then annealing the sheet at about 630°C, and then air cooling the hot –rolled sheet.
60
50
Cold rolling the sheet from step 20, or the cast plate from step 10 if step 20 is omitted, to a thickness less than about 0.020″ using a plurality of reduction passes with each pass causing a substantially constant thickness reduction of the sheet that is a single nominal value selected within a range from about a 0.001″ to about a 0.005″ reduction per pass.
30

METHOD OF FABRICATING A URANIUM-BEARING FOIL

GOVERNMENT RIGHTS

The U.S. Government has rights to this invention pursuant to contract number DE-AC05-00OR22800 between the U.S. Department of Energy and Babcock & Wilcox Technical Services Y-12, LLC.

FIELD

This disclosure relates to the field of thin metal foils. More particularly, this disclosure relates to fabrication methods for uranium-bearing foils.

BACKGROUND

Uranium metal foils have applications as targets in research reactors to induce beam scattering and applications in the production of special isotopes such as $^{99m}$Tc (a metastable nuclear isomer of technetium-99) that is used for medical purposes. The production of such foils is typically difficult and expensive. What is needed therefore is an improved method of forming uranium-bearing foils.

SUMMARY

In one embodiment the present disclosure provides a method of forming a uranium-bearing foil. In this embodiment the method includes a step of cold rolling a uranium-bearing sheet to a thickness less than about 0.02" using a plurality of reduction passes with each pass causing a substantially constant thickness reduction of the uranium-bearing sheet that is within a range from about a 0.001" reduction per pass to about a 0.005" reduction per pass to form the uranium-bearing foil. A further embodiment provides a method of forming a uranium-bearing foil that includes as step of casting a uranium-bearing plate having a thickness that is up to about 0.30". The method includes a further step of cold rolling the uranium-bearing plate to a thickness less than about 0.02" using a plurality of reduction passes with each pass causing a substantially constant thickness reduction of the uranium-bearing sheet that is within a range from about a 0.001" reduction to about a 0.005" reduction per pass to form the uranium-bearing foil.

BRIEF DESCRIPTION OF THE DRAWING

Various advantages are apparent by reference to the detailed description in conjunction with the FIGURE accompanying this application, describing the steps of a method for forming a foil.

DETAILED DESCRIPTION

The following detailed description presents preferred and specific embodiments of a method of forming a thin foil sheet from a uranium-bearing plate or casting. It is to be understood that other embodiments may be utilized, and that structural changes may be made and processes may vary in other embodiments.

Most processes for forming a metal foil involve successive rolling operations (passes) with a rolling mill to reduce the thickness of a workpiece. The term "workpiece" refers to the metal stock material that is used to form the foil. Generally the workpiece starts as a metal plate that is rolled into a thin sheet, which is then rolled into the foil. Typically, in standard processes, the successive rolling operations result in a generally constant percent reduction of the thickness of the workpiece with each pass. So, for example, if the process begins with a 0.10" thick plate the first pass might reduce the thickness of the workpiece by about 10%, which would reduce the thickness by about 0.01" and result in a workpiece that is about 0.09" thick. The symbol "\"" used herein refers to "inch" or "inches," with the choice between "inch" or "inches" being evident by the numerical context. The second pass might reduce the thickness by about another 10%, which would reduce the thickness by about 0.009" and result in a workpiece that is about 0.081" thick. Continuing with this standard process, the third pass might reduce the thickness by about another 10%, which would reduce the thickness by about 0.0081" and result in a workpiece that is about 0.0729" thick. In other words, in such a standard technique, each pass reduces the thickness by a generally constant percentage, which translates to reductions in dimensional thicknesses that are smaller with each pass.

In contrast with such standard techniques, other methods are described herein that use a generally constant dimensional thickness reduction with each pass instead of a standard generally constant percentage reduction with each pass. The constant dimensional thickness reduction process results in a comparatively small percentage reduction for the first pass (compared with subsequent passes) and a comparatively large percentage reduction on the last pass. For example, if the process begins with a 0.10" thick plate the first pass might reduce the thickness by about 0.01" to produce a workpiece that is 0.09" thick, as in the standard process. This is a 10% reduction in thickness. However, in various embodiments described herein, the second pass may also reduce the thickness of the workpiece by 0.01" to produce a workpiece that is 0.08" thick. This is about an 11% reduction for the second pass. The third pass may further reduce the thickness of the workpiece by 0.01" to produce a workpiece that is 0.07" thick. This is about a 13% reduction for the third pass.

Typically in many embodiments the first few passes are made at very low percent reductions, such as perhaps reductions ranging from about 2% to about 3%. The final passes may reduce the foil thickness by over 15% per pass. This approach is rather counterintuitive. When the rolling operations begin the workpiece is typically in its most ductile condition, and one might expect to achieve success by making the largest percentage reductions of thickness at the beginning. Additionally, because successive rolling operations tend to strain harden a foil and produce residual stresses in a foil, one might not expect to achieve success by making the largest percentage reductions in the final passes when the material has the most strain hardening and residual stresses.

Many embodiments produce thin foils of a uranium-bearing material. "Uranium-bearing" refers to a material that comprises uranium. Such material may consist entirely or substantially entirely of uranium, or such material may be a uranium alloy. Many embodiments are directed toward the fabrication of foils made of a uranium-molybdenum alloy, and typically that alloy contains about 10% molybdenum.

In some embodiments the uranium-bearing material may initially be cast as a plate that generally has a thickness greater than about 0.10" and typically has a thickness that is within a range from about 0.20" to about 0.75". As used herein the term "thickness that is within a range" refers to the thickness of a least a portion of the object described. Generally the thickness of the entire portion varies less than the entire range that is identified for the thickness of the object. However the term "thickness that is within a range" also encompasses an object having a portion that varies in thickness over the entire identified range, from the low end of the range to the high end of the range. A cast plate having a thickness of about 0.375" is typical. A cast plate having a thickness of about 0.875" is generally too thick to work well in a subsequent rolling process.

In some embodiments for fabrication of foil, the cast plate may optionally be preheated to about 630° C. and then hot rolled in one or more passes at an elevated temperature to a thickness of less than about 0.10", with a typical thickness after all passes of hot rolling that range from about 0.02" to about 0.10". If the hot rolling process is performed in less than about three minutes the plate will generally stay hot enough to complete the hot rolling process without requiring any in-process heating of the plate. If the hot rolling process starts to make an inordinate amount of noise (e.g., squeaking and clunking), then that is generally an indication that the plate should be re-heated to about 630° C. before continuing with hot rolling. In this hot rolling phase a generally constant percentage reduction process may be used where thickness reductions are about 10% per pass. "Constant percentage" reduction passes are considered herein to be constant if they vary no more than about ±20% of the nominal constant percentage amount. Therefore, reductions from a "constant percentage" reduction process of about 10% per pass may actually reduce the thickness of the material by an amount that varies within a range between about 8% and 12% per pass. After achieving the final sheet thickness the hot-rolled sheet is then typically annealed at about 630° C. and air cooled to room temperature.

To produce a finished foil, a workpiece (either an as-cast plate or hot rolled and annealed sheet) is typically cold rolled using a plurality of rolling passes of generally constant thickness reduction until the workpiece is a foil having a thickness less than about 0.02". As used herein the term plurality of rolling passes of "substantially constant thickness reduction" refers to a plurality of passes wherein thickness reduction does not vary by more than about ±10% over the plurality of passes. Typically each reduction pass causes a substantially constant thickness reduction of the uranium-molybdenum sheet that is a single nominal value selected within a range from about 0.001" to about 0.005" per pass to form the finished foil. Most typically the substantially constant thickness reduction is nominally about 0.0025" per pass. With the ±10% variation allowed herein for a "substantially constant thickness reduction" process, each thickness reduction under a nominal 0.0025" constant thickness reduction process may vary between 0.00225" and 0.00275".

The FIGURE accompanying this application describes steps employed in some embodiments of methods for fabricating uranium-bearing foils. In step 10 a uranium-bearing plate is cast. In the embodiment described by the FIGURE, the plate has a thickness that is within a range from about 0.10" to about 0.75". The reference to "about" in that range refers to variances that accommodate at least −0.025" on the lower limit and least +0.025" on the upper limit. In step 20 of this embodiment, if the cast plate has a thickness that is greater than about 0.30", the cast plate is hot rolled to form a sheet having a thickness that is within a range from about 0.02" to about 0.10". In some embodiments step 20 is not employed, particularly in embodiments where the plate cast in step 10 has a thickness that is less than about 0.20". In step 30 the sheet from step 20 (or the plate from step 10 if step 20 is not employed) is cold rolled to a thickness less than about 0.02" using a plurality of reduction passes with each pass causing a substantially constant thickness reduction of the sheet that is within a range from about a 0.001" to about a 0.005" reduction per pass.

Quite unexpectedly, finished foils fabricated by methods described herein are typically very ductile as rolled, without the application of any subsequent annealing step. As an indication of such ductility, a foil fabricated according to the processes described herein may typically be coiled and uncoiled around a 1.5" diameter spool multiple times (more than five times, typically) without cracking or otherwise damaging the foil.

The FIGURE illustrates by arrow 40 that some embodiments may begin at step 20 using a uranium-bearing plate that may be fabricated by a process other than by step 10. The FIGURE illustrates by arrow 50 that some embodiments may begin at step 30 by using a uranium-bearing plate or sheet that may be fabricated by a process other than by step 10 or step 20. The FIGURE illustrates by arrow 60 that some embodiments may skip step 20.

In summary, embodiments disclosed herein provide a method for forming a uranium-bearing foil. The method typically includes a series of hot rolling operations on a cast plate material to form a thin sheet, followed by a series of cold rolling operations on the thin sheet to form the foil. The plate is typically annealed before the start of hot rolling operations and the sheet is typically annealed before the start of cold rolling operations.

The foregoing descriptions of embodiments have been presented for purposes of illustration and exposition. They are not intended to be exhaustive or to limit the embodiments to the precise forms disclosed. Obvious modifications or variations are possible in light of the above teachings. The embodiments are chosen and described in an effort to provide the best illustrations of principles and practical applications, and to thereby enable one of ordinary skill in the art to utilize the various embodiments as described and with various modifications as are suited to the particular use contemplated. All such modifications and variations are within the scope of the appended claims when interpreted in accordance with the breadth to which they are fairly, legally, and equitably entitled.

What is claimed is:

1. A method of forming a uranium-bearing foil comprising cold rolling a uranium-bearing sheet to a thickness less than about 0.02" using a plurality of reduction passes with each pass causing a substantially constant thickness reduction of the uranium-bearing sheet to form the uranium-bearing foil.

2. The method of claim 1 wherein the substantially constant thickness reduction is selected within a range from about a 0.001" reduction per pass to about a 0.005" reduction per pass.

3. The method of claim 1 wherein the substantially constant thickness reduction is about 0.0025" per pass.

4. The method of claim 1 further comprising the steps prior to the cold rolling:

hot rolling a uranium-bearing plate to form the uranium-bearing sheet, wherein the uranium-bearing sheet has a thickness that is within a range from about 0.02" to about 0.10"; and annealing the uranium-bearing sheet at about 630° C.

5. The method of claim 1 further comprising the steps:

prior to the cold rolling, hot rolling a uranium-bearing plate using a plurality of substantially constant percentage reduction passes to form the uranium-bearing sheet, wherein the uranium-bearing sheet has a thickness that is within a range from about 0.02" to about 0.10";

annealing the uranium-bearing sheet at about 630° C.;

and wherein the cold rolling step comprises using a plurality of reduction passes with each pass causing a substantially constant thickness reduction of about 0.0025" per pass to form the uranium-bearing foil.

6. The method of claim 1 wherein the cold rolling step comprises cold rolling a uranium-bearing sheet comprising about ten weight percent molybdenum.

7. A method of forming a uranium-bearing foil comprising:

casting a uranium-bearing plate having a thickness that is less than about 0.75";

hot rolling the uranium-bearing plate to form a uranium-bearing sheet having a thickness that is within a range from about 0.02" to about 0.10";

annealing the uranium-bearing sheet at about 630° C.; and cold rolling the uranium-bearing sheet to a thickness less than about 0.02" using a plurality of reduction passes with each pass causing a substantially constant thickness reduction of the uranium-bearing sheet to form the uranium-bearing foil.

8. The method of claim 7 wherein the substantially constant thickness reduction is selected within a range from about a 0.001" reduction per pass to about a 0.005" reduction per pass.

9. The method of claim 7 wherein the substantially constant thickness reduction is about 0.0025" per pass.

10. The method of claim 7 wherein the casting step comprises casting a uranium-bearing plate comprising about ten weight percent molybdenum.

11. A method of forming a uranium-bearing foil comprising:

casting a uranium-bearing plate having a thickness that is less than about 0.30";

cold rolling the uranium-bearing plate to a thickness less than about 0.02" using a plurality of reduction passes with each pass causing a substantially constant thickness reduction of the uranium-bearing plate to form the uranium-bearing foil.

12. The method of claim 11 wherein the substantially constant thickness reduction is selected within a range from about a 0.001" reduction to about a 0.005" reduction per pass.

13. The method of claim 11 wherein the substantially constant thickness reduction is about 0.0025" per pass.

14. The method of claim 11 wherein the casting step comprises casting a uranium-bearing plate comprising about ten weight percent molybdenum.

15. A method of forming a uranium-bearing foil comprising:

hot rolling a uranium-bearing plate using a plurality of substantially constant percentage reduction passes to form a uranium-bearing sheet, wherein the uranium-bearing sheet has a thickness that is within a range from about 0.02" to about 0.10";

annealing the uranium-bearing sheet at about 630° C.;

cold rolling the uranium-bearing sheet to a thickness less than about 0.02" using a plurality of reduction passes with each pass causing a substantially constant thickness reduction of the uranium-bearing sheet to form the uranium-bearing foil.

* * * * *